US007041039B2

(12) United States Patent
Wang et al.

(10) Patent No.: US 7,041,039 B2
(45) **Date of Patent: *May 9, 2006**

(54) INTERACTIVE BOXING TRAINER

(76) Inventors: Leao Wang, No.1, Lane 233, Sec.2, Charng Long Rd., Taiping 411 (TW); Peter Wu, No.1, Lane 233, Sec.2, Charng Long Rd., Taiping 411 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/687,020

(22) Filed: Oct. 17, 2003

(65) Prior Publication Data

US 2004/0110606 A1 Jun. 10, 2004

Related U.S. Application Data

(63) Continuation-in-part of application No. 10/315,257, filed on Dec. 10, 2002, now Pat. No. 6,872,172.

(51) Int. Cl.
*A63B 21/00* (2006.01)

(52) U.S. Cl. ..... 482/87; 482/83; 482/89

(58) Field of Classification Search ..... 482/83–90; 473/446, 438, 447, 441

See application file for complete search history.

(56) References Cited

U.S. PATENT DOCUMENTS

| | | | | |
|---|---|---|---|---|
| 4,030,731 | A * | 6/1977 | Delcayre | 463/47.1 |
| 4,401,303 | A * | 8/1983 | Anderson et al. | 482/4 |
| 4,771,394 | A * | 9/1988 | Cavanagh | 702/160 |
| 4,824,107 | A * | 4/1989 | French | 273/454 |
| 5,184,831 | A * | 2/1993 | Garner | 273/455 |
| 5,723,786 | A * | 3/1998 | Klapman | 73/379.04 |
| 5,844,861 | A * | 12/1998 | Maurer | 368/10 |

* cited by examiner

*Primary Examiner*—Jerome W. Donnelly
(74) *Attorney, Agent, or Firm*—Troxell Law Office, PLLC

(57) ABSTRACT

The invention relates to an interactive boxing trainer which includes a main frame, a driving unit, a control unit, a pair of boxing gloves with a respective signal transmitter and a pair of shoes with a respective signal transmitter. The main frame contains a longitudinal slide rail, a lateral slide rail and a punched body. The driving unit moves the punched body on the longitudinal slide rail and the lateral slide rail. Moreover, the control unit is in connection with a plurality of signal receivers positioned at the upper and lower part of the main frame so as to receive signals sent by the signal transmitters on the boxing gloves and shoes. Therefore, the position, speed and travelling path of the boxing gloves can be detected and processed by the control unit which then commands the driving unit to move the punched body away from the approaching gloves and shoes.

1 Claim, 2 Drawing Sheets

INTERACTIVE BOXING TRAINER

This invention is a continuation-in-part of U.S. patent application Ser. No. 10/315,257, filed on Dec, 10, 2002, now U.S. Pat. No. 6,872,172.

BACKGROUND OF THE INVENTION

1. Fields of the Invention

The invention relates to an interactive boxing trainer, and more particularly, to a device that automatically detects and escapes from boxing gloves and shoes to improve the training effect and enhance the training fun.

2. Description of the Related Art

The conventional boxing exercisers belong to "in-place" device (i.e. punching bag) for boxing training. The punching bag is suspended so that it swings to and fro when punched by fists of operators. Therefore, the operator has to watch its swinging position and speed to give the next punching so as to achieve a certain training effect. In practice of the basic boxing defense, both boxers duly dodge in accordance with the punching position and timing of the opponent. However, the attacking side has to grasp the attack opportunity unlike the easy practice on the punching bag.

In order to carry out "interactive practice" to command the punching timing and skills, all boxers have to employ one of boxers of equal caliber to simulate the boxing match.

In consideration of many objective factors such as expenses, time, possible injuries, it's rare for common boxers to employ the so-called "interactive practice". Particularly, the beginners can hardly command the basic punching timing and boxing skills without the interactive practice, let alone imagine the real situation in the boxing match beforehand.

SUMMARY OF THE INVENTION

Therefore, it is a primary object of the invention to eliminate the above-mentioned drawbacks and to provide an interactive boxing trainer that utilizes the modem technique of automatic detection and automatic control for the operator to be in command of the position, the speed and the travelling path of the boxing gloves and shoes. Moreover, the instant shift of the automatic driving unit will keep the punched body away from the approaching boxing gloves and shoes. Therefore, the boxer has to use special skills (rapid movement of the feet, rapid punching of the fists, continuous punching, deceiving punching or punching according to the movement direction of the punched body) before or during punching and kicking so as to exactly hit the punched body. Therefore, the punching difficulty is increased to practice the punching skills. Furthermore, the trainee won't be injured by counterattack, and he can make practice at any time without the time restriction.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

It's to note that the invention is a continuation-in-part of U.S. patent application Ser. No. 10/315,257.

Figure 1:
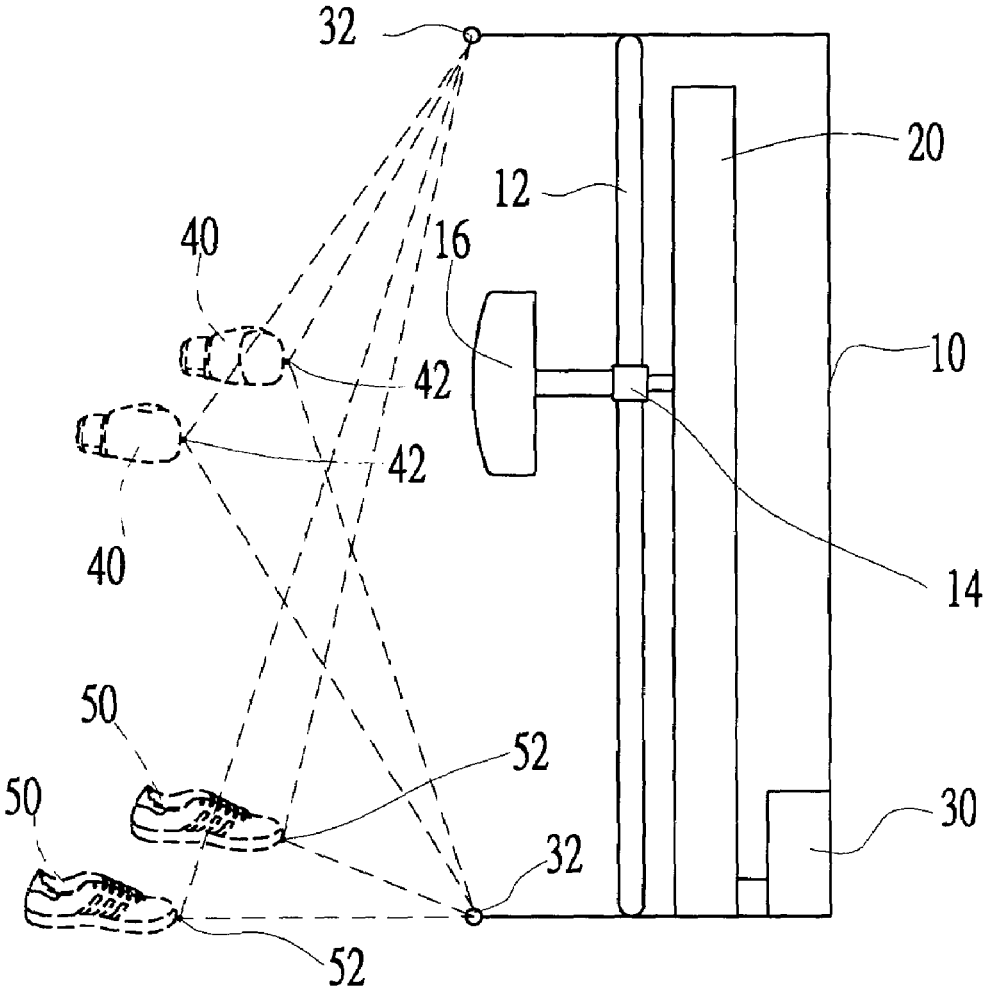
FIG. 1 is a side view of a preferred embodiment of the invention.
Figure 2:
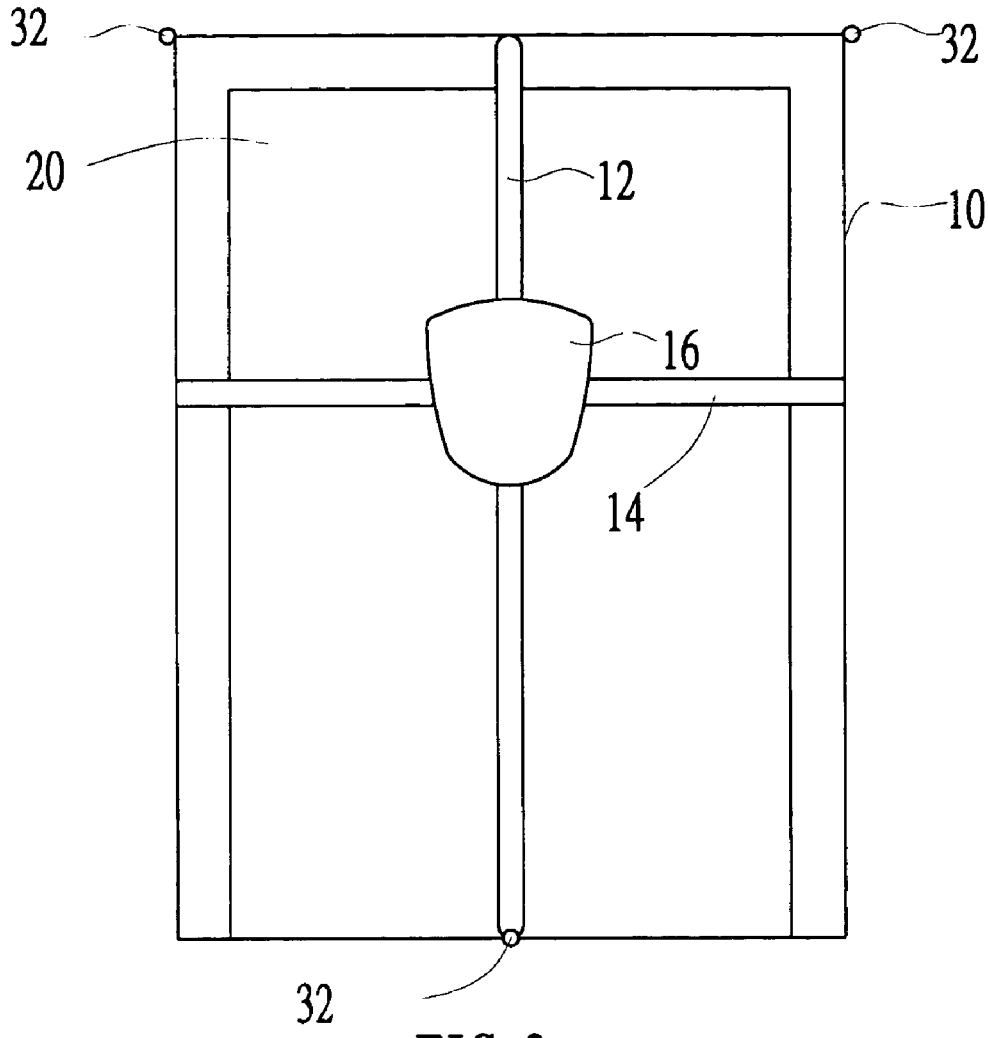
FIG. 2 is a front view of the preferred embodiment of the invention.

Referring to FIGS. 1 and 2, a preferred embodiment of the invention is shown. From the figures, the interactive boxing trainer includes a main frame 10, a driving unit 20, a control unit 30, a pair of boxing gloves 40 with a glove signal transmitter 42, and a pair of shoes 50 with a shoe signal transmitter 52, respectively. The main frame 10 contains a longitudinal slide rail 12, a lateral slide rail 14 and a punched body 16. The punched body 16 is movable by the driving unit 20 on the longitudinal slide rail 12 and the lateral slide rail 14. Moreover, the control unit 30 is in connection with a plurality of signal receivers 32 positioned at the upper and lower part of the main frame 10 so as to receive signals sent by the signal transmitters 42, 52 of the boxing gloves and shoes 40, 50, respectively. Therefore, the position, speed and travelling path of the boxing gloves and shoes 40, 50 can be detected and processed by the control unit 30 which then commands the driving unit 20 to move the punched body 16 away from the approaching gloves and shoes 40, 50.

In order to effectively distinguish the boxing gloves and shoes 40, 50, the signal transmitters 42, 52 give out different frequency signals. Thus, the relative distance from the boxing gloves 40 and the shoes 50 to the punched body 16 can be reckoned by the signal receivers 32 in accordance with different range of frequency. Thereafter, the control unit 30 gives command to the driving unit 20 to proceed with further proper reaction. Besides, pairwise signal receivers 32 can be arranged to detect different signals given out by the signal transmitters 42, 52 of the boxing gloves 40 and the shoes 50, respectively, so as to fulfill the aforementioned function. This technique belongs to the prior art so that no further descriptions thereto are given hereinafter.

Furthermore, how the control unit 30 operates the driving unit 20 and in which direction and how far the punched body 16 is moved away from the boxing gloves and shoes 40, 50, belong to the programming field so that no further descriptions thereto are given hereinafter as well.

In brief, the control unit 30 of the invention makes use of at least two pairs of signal receivers 32 at the top and bottom to interact with the signal transmitters 42, 52 for exactly measuring the position, the speed and the traveling path of the boxing gloves and shoes 40, 50. Accordingly, the dual positioning method allows a more accurate processing procedure. Besides, the driving unit 20 laterally (X-axis) and longitudinally (Y-axis) shift the punched body 16 to simulate the dodge movement of the opponent in the real boxing match. Meanwhile, the punched body 16 can be arranged to move forward and backward (Z-axis) when required.

Many changes and modifications in the above-described embodiment of the invention can, of course, be carried out without departing from the scope thereof Accordingly, to promote the progress in science and the useful arts, the invention is disclosed and is intended to be limited only by the scope of the appended claim.

What is claimed is:

1. An interactive boxing trainer comprising:

a) a main frame having a longitudinal slide rail, a lateral slide rail and a punched body;

b) a device moving said punched body on said longitudinal slide rail and said lateral slide rail;

c) a pair of boxing gloves each having a glove signal transmitter;

d) a pair of boxing shoes each having a shoe signal transmitter; and e) a control unit in connection with a plurality of signal receivers positioned at upper and lower parts of said main frame receiving signals sent by the glove signal transmitter on each of the pair of boxing gloves and the shoe signal transmitter on each of the pair of shoes;

whereby said control unit detecting a position, a speed and a travelling path of said boxing gloves and shoes and controlling said driving unit to move said punched body away from said approaching gloves and shoes.

* * * * *